US005195230A

United States Patent [19]

Krietzman

[11] Patent Number: 5,195,230

[45] Date of Patent: Mar. 23, 1993

[54] IMPACT TOOL AND BLADE

[75] Inventor: William Krietzman, Beaverton, Oreg.

[73] Assignee: Harris Corporation, Melbourne, Fla.

[21] Appl. No.: 589,599

[22] Filed: Sep. 28, 1990

[51] Int. Cl.[5] ..... H01R 43/00

[52] U.S. Cl. ..... 29/566.4; 29/751

[58] Field of Search ..... 29/566.4, 566.1, 751, 29/758, 566.3, 750, 278, 33 M; 173/120; 7/107, 158

[56] References Cited

U.S. PATENT DOCUMENTS

| | | | |
|---|---|---|---|
| 2,774,133 | 12/1956 | Sitz | 29/254 |
| 2,960,864 | 11/1960 | Watts | 73/862.01 |
| 3,074,155 | 1/1963 | Cootes et al. | 29/739 |
| 3,177,952 | 4/1965 | West | 173/121 |
| 3,279,044 | 10/1966 | Roper | 29/739 |
| 3,708,852 | 1/1973 | Mason | 29/749 |
| 3,883,316 | 5/1975 | Mason | 29/566.4 |
| 4,161,061 | 7/1979 | Mason et al. | 29/566.4 |
| 4,241,496 | 12/1980 | Gregson | 29/751 |
| 4,434,542 | 3/1984 | Forberg et al. | 29/278 X |
| 4,567,639 | 2/1986 | Fasano | 29/566.4 |
| 4,624,521 | 11/1986 | Vachhani | 439/396 |
| 4,663,838 | 5/1987 | Dewey et al. | 29/751 |
| 4,682,412 | 7/1987 | Pfeffer | 29/750 |
| 4,696,090 | 9/1987 | Gregson et al. | 29/566.4 |

FOREIGN PATENT DOCUMENTS

| | | | |
|---|---|---|---|
| 949299 | 6/1974 | Canada | 29/751 |
| 3736031 | 5/1989 | Fed. Rep. of Germany | 29/751 |

OTHER PUBLICATIONS

Porta Systems, 508PFBQT Brochure, Feb. 1985.

Northern Telecom Bix Cross-Connect System Brochure, Jun. 1980.

*Primary Examiner*—William Briggs

*Attorney, Agent, or Firm*—Evenson, Wands, Edwards, Lenahan & McKeown

[57] ABSTRACT

A hand-held impact tool for effecting terminations in a telecommunications terminal block uses a blade with a setting edge and a pivotable cutter for cutting a conductor wire. Several impact settings for varying the seating impact force at the blade are settable by moving a pouch relative to the handle in one direction. Movement of the pouch in another direction will allow release of a blade stored inside the pouch or insertion of a blade into an empty pouch. A switch on the handle allows the cutter to be actuated by compression and release of the tool or to be disengaged so that only an impact seating function occurs.

18 Claims, 9 Drawing Sheets

IMPACT TOOL AND BLADE

BACKGROUND AND SUMMARY OF THE INVENTION

The present invention relates to an impact tool, blade and cutting method used by telecommunications personnel for insertion and removal of conductor wire in connector blocks and the like. More particularly, the present invention relates to a wire insertion, hand-operated impact tool blade and method which provide in a simple and reliable manner a selectively actuatable cutting function and from one location, two impact setting positions, a setting for no impact where only cutting is desired and blade release from a pouch.

Impact tools for effecting an electrical connection have long been known as shown in U.S. Pat. No. 2,774,133. Such tools basically utilize the operating mechanism of a self-triggering nail set or center punch but with a specially designed operating plunger. A similar form of insertion tool is shown in U.S. Pat. No. 2,960,864 in which a plunger is compacted by a hammer which, in the rest position, is biased by a compression coil spring such that the hammer is canted or tilted relative to the longitudinal axis of the tool.

Another form or insertion hand tool is disclosed in U.S. Pat. No. 3,074,155. A cylindrical detent in a hammer is biased outwardly by a spring and extends partially through a circular opening in a barrel. Upon application of inserting force by an operator who grasps the tool by the handle and pushes a pin into a receptacle, the outer handle is moved relative to the barrel and progressively cams the detent inwardly against the spring bias. When the detent has been cammed inwardly to a sufficient extent, the hammer is triggered, and the kinetic energy of the hammer is transmitted to a rod and thence to the connector.

Similar types of impact tools are shown in U.S. Pat. Nos. 3,177,952 and 3,279,044.

Another type of impact tool is known as a termination tool for use in the communications industry which inserts an insulated wire into the fork of a bifurcated termination clip and cuts the wire beyond the termination. Typically, as shown in U.S. Pat. No. 3,708,852, the tool has a manually operable handle and a terminal blade movably mounted with respect to the handle. A spring is provided between the blade and handle so that, upon increased pushing of the handle by an operator, a hammer stroke from the handle onto the blade is produced to finalize and cut off the termination with a minimum amount of physical effort. To this end, a hammer is slidably movable in guide surfaces in an upper part of the handle. A spring engages against the hammer which normally rests against a stop surface in the handle. An adjusting screw is also provided in the handle to increase the force by which the at-rest hammer is urged against the stop surface. The hammer has a bore which receives a pin and a cross-bore which receives a sear having a release hole urged outwardly of the cross bore by an elastomeric pad or the like. A cam surface is formed on the side of a guide surface in the handle adjacent the hammer and is positioned so that when the hammer is in its rest position, the sear is permitted to move to the right with its release hole out of alignment with the bore in the hammer and with a pin of an anvil. As manual force is applied to the top of the handle in a direction to cause a wire to be seated in a clip of a telephone connection block, the hammer spring and a return spring are compressed. The hammer is moved upwardly, and the sear is moved inwardly by the cam surface until the release hole aligns with the bore in the hammer at which point a slide shoulder on the anvil is above the stop surface against which the hammer normally rests. Upon release, the hammer is driven downwardly by the compressed power spring so that the lower surface of the hammer strikes the slide shoulder. The hammer blow causes the blade to seat and cut off the wire.

Similar types of termination tool blades are shown in U.S. Pat. Nos. 3,883,316; 4,161,061; 4,241,496; and 4,696,090. In the first-mentioned patent, the terminal tool uses a reversible blade. In the second-mentioned patent, the reversible blade uses an L-shaped bayonet slot and a cam follower spring in a groove on the tool slide to interlock the blade and yet allow it to be quickly removed. The third-mentioned patent provides a blade storage pouch in the tool handle which releasably retains with one rotatable knob a termination blade. In addition, a second rotatable knurled knob is provided to shorten and lengthen a power spring between two positions for setting the impact at either a high level or a low level for delivery to the slide. In order to obtain a seating function without a cutting function the blade, such as the "66" blade (a cutting edge at only one of the ends) available on the market, must be removed from the tool and reversed to present the seating edge which does not also have the knife edge as is present on the other end of the blade. The fourth-mentioned patent discloses a scissor-like removeable blade assembly on which the cutter member is always in the actuator position and is used on the tool described in the third-mentioned patent.

More recently, other types of insertion tools and electrical connector methods have been developed as shown for example, in U.S. Pat. Nos. 4,567,639; 4,624,521; 4,663,838; and 4,682,412. One such connecting tool is the "BIX"-blade marketed by Cook Electric and designed to seat 22–26 gauge wire in miniature quick-clips. As the tool is withdrawn, a spring loaded shear cuts off the free end of the wire. The tool can also be adjusted to seat the wire without cutting if looping is desired.

Heretofore, however, it has not been known how to provide a simply constructed and highly reliable impact tool having the ability to adjust the impact force, store the blade in a pouch using the friction of a coil spring tightening around the center section of the tool and the versatility selectively to cut wire without impact, impact without cutting or both cut and impact. For instance, although a seating through impact without cutting was possible, as in the above-mentioned "66" blade system, the converse was not true. Moreover, it was necessary to utilize multiple knobs to effect blade release and changes in impact setting as shown in U.S. Pat. No. 4,241,496.

An object of the present invention is, therefore, to provide a simply constructed and highly reliable tool having compact force, blade storage capability and a mechanism which switches between cutting and non cutting positions of the blade in a particularly advantageous manner, and a cutting method which provides reliable cutting of wires.

A further object of the invention is to provide a modified blade design with a possible scissor-like cutter which allows engagement and disengagement of the blade in a simple and efficient manner.

It is another object of the present invention to construct an impact tool with a minimum number of components while providing maximum versatility.

It is still a further object of the present invention to configure an impact tool in as compact and streamlined a manner as possible so as to be easily adjustable and comfortable in the hands of most telecommunications equipment personnel.

Yet another object of the present invention is to provide a switch for the cutting function which is easily accessible and operable by the thumb of the operator's hand merely by sliding a switch between two positions, namely the cut and the no-cut positions.

These objects have been achieved in accordance with the present invention by constructing the tool and blade such that a slidable switch on the tool handle moves a cutter actuator axially inside the tool handle to and from the end of a pivotable scissor blade.

Another feature of the present invention which accomplishes the foregoing objectives is a cam located in the rearward portion of the handle to cooperate with a cam surface on the inner wall of the handle to move from a "NO" impact setting to a "LO" impact setting, then to a "HIGH" impact setting and back to the "NO" impact setting.

Yet another feature of the present invention is the utilization of a deactivator member provided within the handle so as to allow the tool to be put into the cutting position without an impact function.

A pouch at the end of the handle sets the two impact settings and the no-impact setting by turning the cam on the handle in one direction. The pouch has an axial opening in the rear end for holding a termination blade or the like and for releasing the same by rotation of the pouch in the opposite direction.

A cantered or tiltable hammer is arranged in the handle and is urged toward a rest position by a relatively stiff coil spring which acts as the power spring for causing the impact blow against a slide when the hammer becomes longitudinally aligned with the axis of the slide.

In the event a cutting function is desired along with the impact seating function, the switch on the handle is thumb actuated toward the forward end (the blade end) of the tool. An actuator connected with the switch is pushed toward the forward end so that its U-shaped legs surround the rear end of a pivotable cutter for a scissor type blade. A trigger cam engages in a slot in the actuator. The slot is sized and configured such that, when the switch is at the "CUT" position, the trigger cam will move to the opposite end of the slot as the handle is moved relative to the slide. The basic movement of the tool by pushing the handle to effect impact is generally otherwise known.

BRIEF DESCRIPTION OF THE DRAWINGS

These and other objects, features and advantages of the present invention will become more readily apparent from the following detailed description of a presently preferred embodiment when taken in conjunction with the accompanying drawings wherein.

DETAILED DESCRIPTION OF THE DRAWINGS

I. Structure of the Impact Tool

Figure 1:
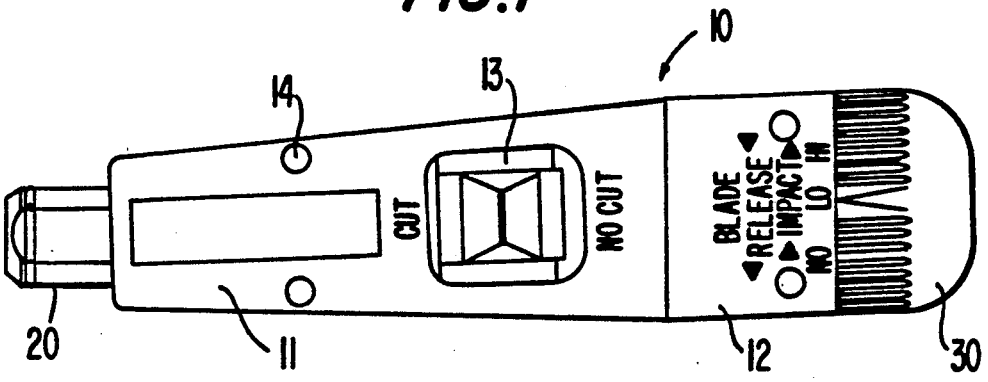
FIG. 1 is a plan view of the impact tool in accordance with the present invention without a blade inserted and shows the side of the tool with the two-position slide switch for the "CUT" and "NO-CUT" positions.
Figure 2:
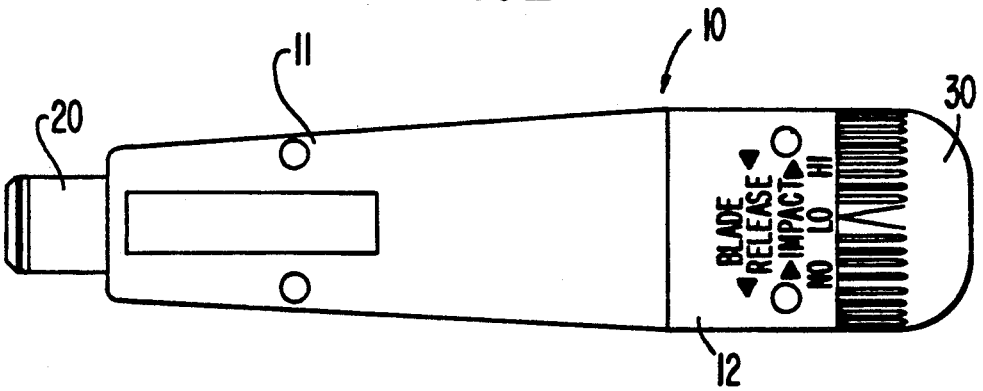
FIG. 2 is a plan view on the reverse side of the view shown on FIG. 1 and shows the "BLADE RELEASE" and "IMPACT" calibrations also on this side in case the operator uses the tool with the switch side down.

The assembled impact tool according to the present invention is designated generally by the numeral 10 in FIGS. 1 and 2. Generally speaking, the impact tool 10 comprises a tapered front handle portion 11, a generally cylindrical rear handle portion 12, a metal slide 20 for holding a blade (not shown in FIG. 1, but shown in FIGS. 14A and 14B) movably extending through the front handle portion 11, a generally cylindrical pouch 30 with a rounded off end portion rotatable relative to the rear handle portion 12 as will be hereinafter described, and a thumb activated sliding switch 13 on the top of the front handle portion 11 for moving to and from "CUT" and "NO CUT" positions as is desired and hereinafter described.

Figure 9:
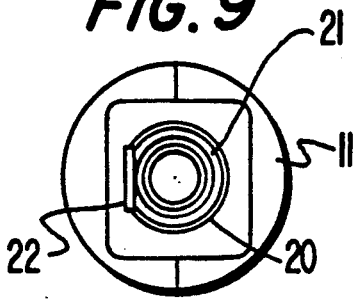
FIG. 9 is a side elevational view of the blade end of the impact tool shown in FIGS. 1 and 2.
Figure 10:
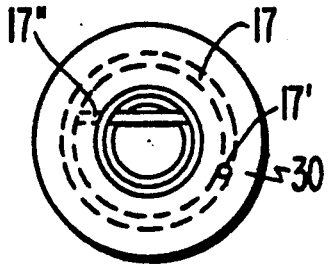
FIG. 10 is a side elevational view of the pouch end of the impact tool shown in FIGS. 1 and 2.
Figure 11:
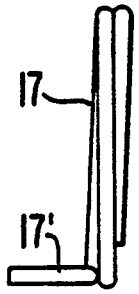
FIGS. 11 and 12 are side and front elevational views of the torsion or coil spring used to capture a blade with the pouch of the tool.
Figure 12:
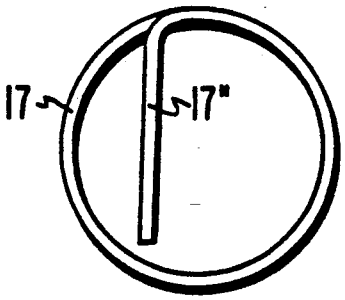

The handle portions 11, 12 are hollow and are comprised of two halves joined together by, for example, four rivets or other type of connector 14. The front handle portion 11 tapers from a circular shape at the end adjacent the rear handle portion 12 to a generally square shape at the end containing the metal slide 20 as best seen in FIG. 9. The parting line between the halves of the front and rear handle portions 11, 12 is in the same plane as the paper on which FIGS. 1 and 2 are shown. The bottom half 15 of the front and rear handle portions 11, 12 is shown on FIGS. 5 and 6. The handle pieces 11, 12 and pouch 30 of the impact tool 10 can be made of any tough plastic material.

Figure 3:
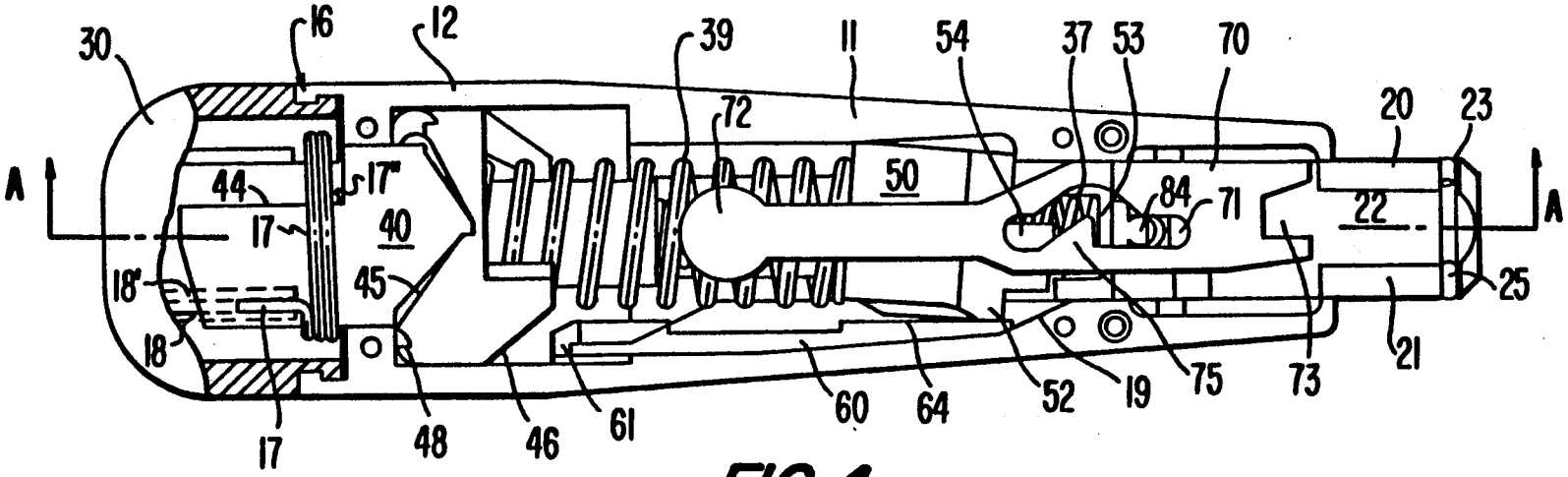
FIG. 3 is a partial sectional view similar to FIG. 1 but with the top handle piece and switch removed.
Figure 4:
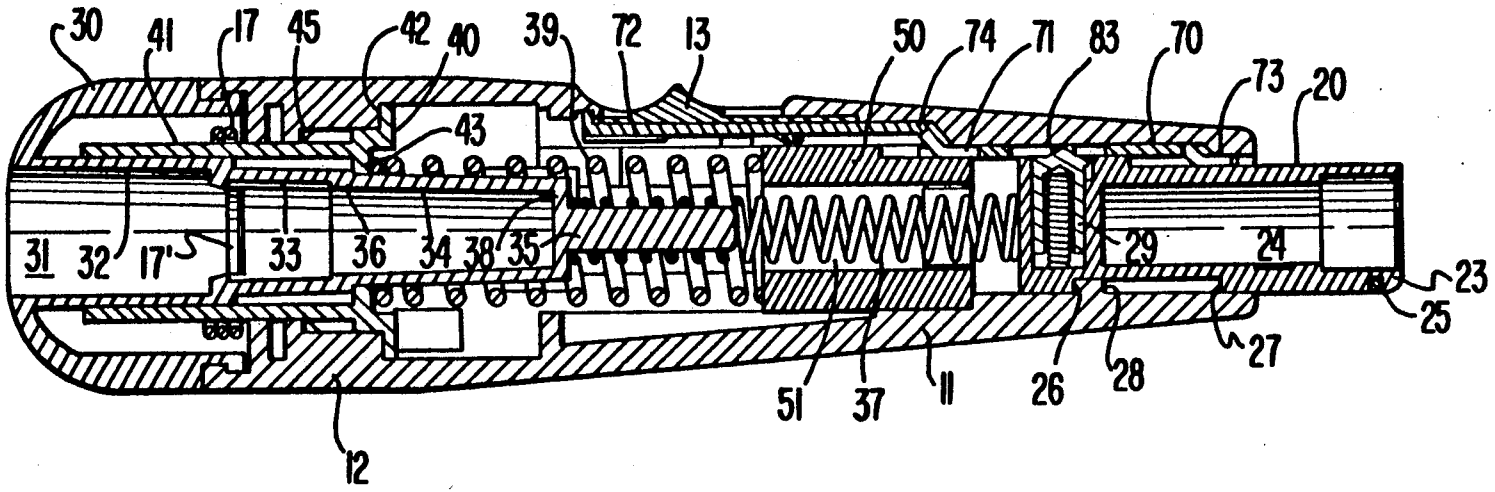
FIG. 4 is a sectional view along line A—A of FIG. 3 but also showing the top handle piece and switch which are not shown in FIG. 3 and the tool in the low-impact, cutting mode with the tool at rest.

FIG. 3 shows the tool 10 with the one-half of the front handle portion 11 and the switch 13 therein removed to show the internal parts and their relationship to each other and a portion of the pouch 30 broken away to show constructional features. FIG. 4 is a cross-sectional view along line A-A of FIG. 3. The pouch 30 contains a central blind hollow portion 31 by virtue of an interior wall 32 extending along the longitudinal axis of the tool 10. The interior wall 32 of the pouch 30 is radially reduced at section 33 which is located within the rear handle portion 12 and thereafter tapers longitudinally at section 34. The forward end of the section 34 contains a blind bore into which a hollow cylindrical spring guide 35 is pressed. A conventional form-locking connection designated by the numeral 16 is provided between the rear handle portion 12 and the pouch 30 to provide a rotatable, but axially fixed connection therebetween.

A cam 40 is provided in the rear handle portion 12 and has, as seen in cross-section in FIG. 4, a generally cylindrical, longitudinally extending wall 41 which axially surrounds the sections 32, 33. The axial position of the cam 40 is fixed relative to the rear handle portion 12 by a shoulder 42 on the inner wall of the rear handle portion 12 against which a surface of the cam 40 rides and by a shoulder 36 formed by the transition between sections 33, 34 against which a radially inwardly depending portion 43 of the cam 40 rides.

A relatively stiff pouch coil spring 17 surrounds the outer surface of the wall 41 of the cam 40. One end 17' of the spring 17 extends longitudinally and is held between two ribs 18, 18' formed on the pouch 30, and the other end 17" of the spring 17 extends parallel to a diametrical line of the pouch 20 and is held by a slot defined between the sections 32, 33 so as to extend through a chordal area of the central aperture 31 for trapping a blade securely therein so as to be distinguished from the frictional holding of the stored blade by the coil spring shown in U.S. Pat. No. 4,241,496. The cam 40 is rotatable in one direction under the bias of the spring 17 by virtue of cut-away portions 44 (only one shown in FIG. 3) in the wall 41 of the cam 40 defining two surfaces engaging the spring end 17" and shoulders on the external surfaces of the section 32, 33.

A hammer 50 is axially and twistably (i.e. in a canting manner shown in FIG. 3) movably arranged within the front handle portion 11. The hammer 50 is of roughly parallelipiped shape and can be made of a sufficiently hard metal material such as carburized steel. A cylindrical bore 51 extends through the hammer 50 to accommodate a relatively weak return spring 37 which is fitted at one end over the spring guide 35, as shown in FIG. 4, and abuts against the exterior terminating end wall 38 of the section 34 so as to bias the slide 20 outwardly to the maximum extent in the normal or rest position. As viewed in FIG. 3 the rear of slide 20 has a U-shaped portion configured to mate with a projection 54 at the forward end of the hammer 50 when the latter is canted counterclockwise during compression of the tool 10 to the triggering point shown in FIG. 17. The forward lower end of a side wall of the hammer 50 is provided with a projection 52 which has a curved camming surface so that in the rest position shown in FIG. 3 the hammer is cantered clockwise. A relatively stiff power spring 39 has a larger diameter than the return spring 37 and is held between the depending lug 43 on the cam 40 and an end face of the hammer 50 surrounding the bore 51.

Figure 5:
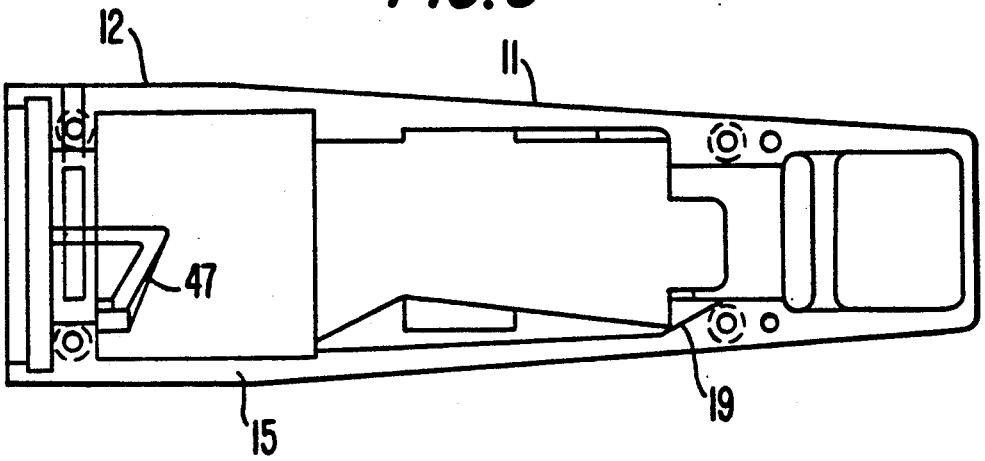
FIG. 5 is a top plan view of the bottom handle piece showing the interior contours including a camming surface for a cam to change the impact settings.
Figure 6:
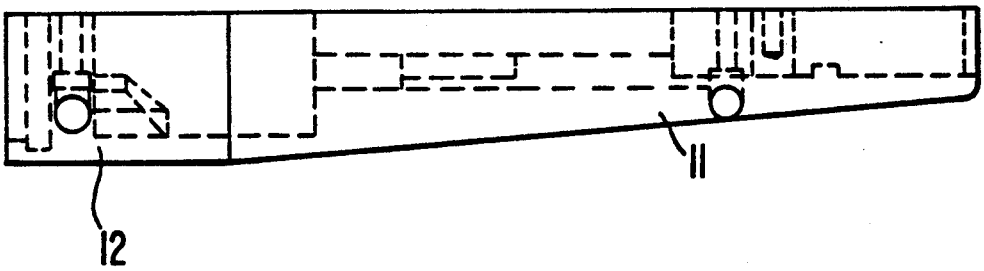
FIG. 6 is a side elevational view of the bottom handle piece shown in FIG. 5.
Figure 7:
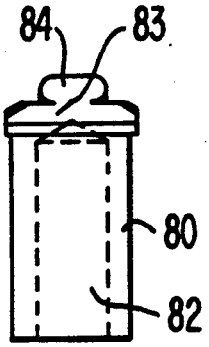
FIGS. 7 and 8 are front and side elevational views of the trigger with a camming surface used to effect movement of the cutting blade to effect a cutting operation.
Figure 8:
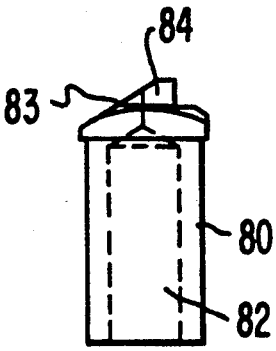
Figure 15:
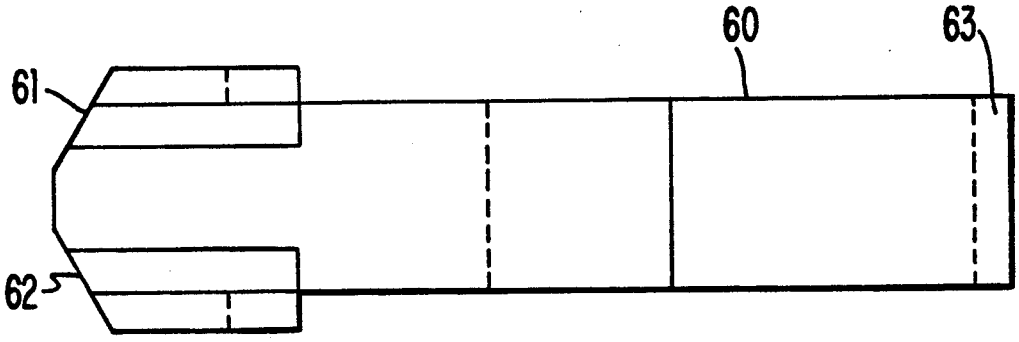
FIGS. 15 and 16 are front and side elevational views of the deactivator provided within the tool handle to effect a no-impact setting when only cutting is desired.
Figure 16:
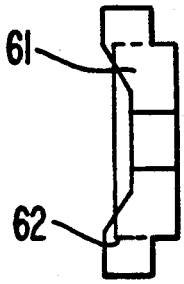

A deactivator 60 is provided at one side of the front handle portion 11 which is provided with a slanted portion 19, as shown more clearly in FIG. 5. The deactivator 60 (FIGS. 15 and 16) is axially movably held against the inner wall of the front handle portion 11 with cam portions 61, 62 at the rearward end and cam portion 63 at the front end so that as the deactivator 60 is pushed axially forward toward the blade end of the tool 10 portion of the cam 40 to the "NO IMPACT" position, as will hereinafter be described, the deactivator 60 will also move radially inwardly of the front portion 11 along the surface 19. The projection 52 at the forward end of the hammer 50 is configured to engage an inner flat surface 64 of the deactivator 60 which is used for the "NO IMPACT" function of the tool 10 as hereinafter described.

The slide 20 can be carburized steel and has a generally cylindrical end portion 21 with a flat portion 22 cut thereon upon which a generally flat actuator 70 rides. The free end of the slide 20 which has a blind bore 24 therein is provided with a circumferential groove 23 into which a spring blade retainer 25 is inserted, with one end of the retainer 25 extending through the circumferential wall of the slide 20 in a known manner, as shown in U.S. Pat. No. 4,241,496 for retaining a blade in the bore 24. The blade inserted in the bore 24 is a scissor-type of blade of modified design and designated generally by numeral 90 in FIGS. 14A and 14B and shown inserted in the tool 10 in FIG. 17 et seq. The slide 20 is configured to move axially through a distance defined by two walls 26, 27 formed by a recess at the bottom of the slide 20. The two walls 26, 27 cooperate with a radially inwardly projecting lug 28 on the inner wall of the top handle portion 11. The end of the slide 20 remote from the free end extending outside the front handle portion 11 also is provided with a bore 29 transverse to a longitudinal axis of the hollow portion 24. The bore 29 carries a trigger 80 which is biased radially outwardly toward the inner wall of the front casing portion 11 by a trigger spring 81 and a bore 82. The trigger 80 has a cam surface 83 with a reduced portion 84 which cam extends through a camming aperture 71 in the flat, blade-like actuator 70.

Figure 14A:
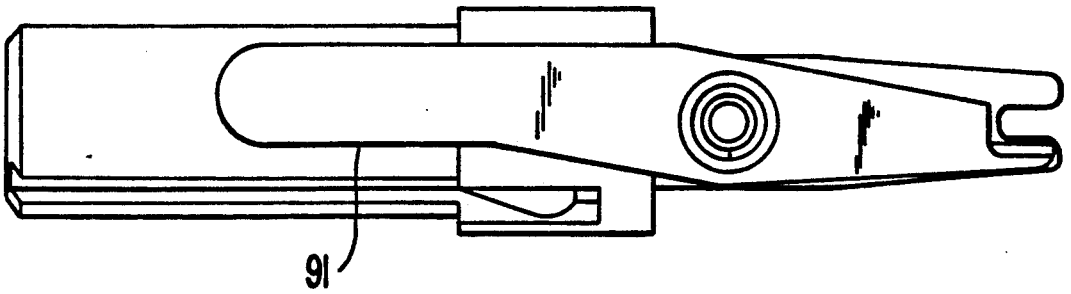
FIG. 14A is a top plan view of a scissor type blade used in the impact tool of FIGS. 1 and 2.
Figure 14B:
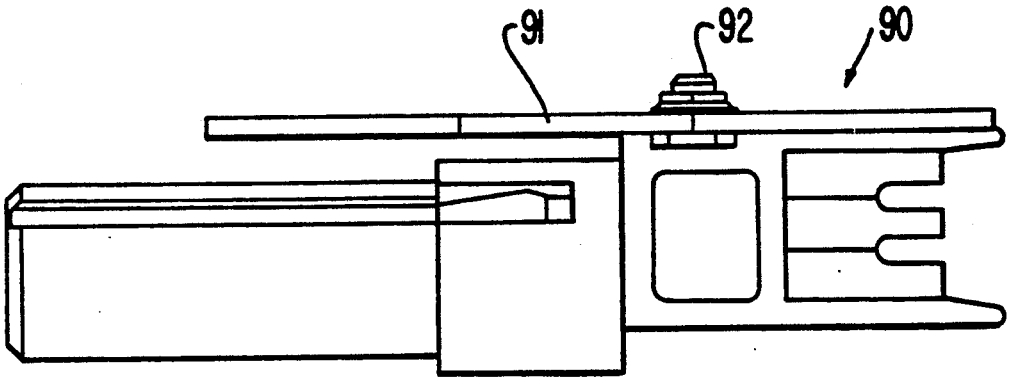
FIG. 14B is a side elevational view of the blade shown in FIG. 14A.
Figure 19:
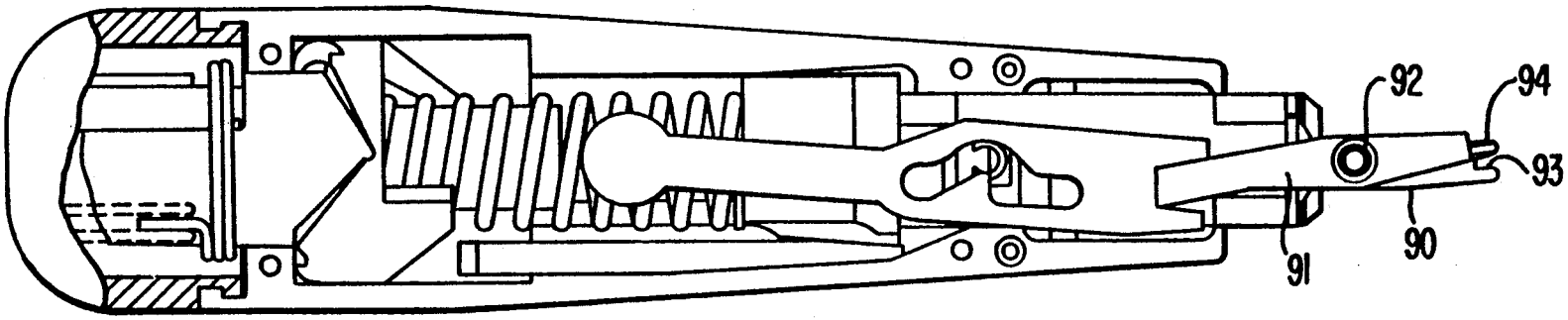
FIG. 19 is a view similar to FIG. 3 but with the trigger now having caused movement of the cutter.

The actuator 70 has a circular portion 72 at one end which is entrained in a circular recess in the switch 13 so that the actuator 70 can swing, as hereinafter described, when the switch 13 has been moved into the "CUT" position. The free end of the actuator 70 near the blade end of the tool 10 is provided with a notched or V-shaped portion 73 to receive the end of a cutter 91 rotatably mounted on the blade, as shown in FIGS. 14A, 14B and 19, for actuating the cutter 91. The notched portion 73 is also offset from the main plane of the actuator 70 by a jog portion so that the cutter 91 can slide underneath during compression of the tool 10. At about the midway portion of the actuator 10, another jog portion 74 is provided to avoid interference with the movement of the hammer 50.

Figure 13:
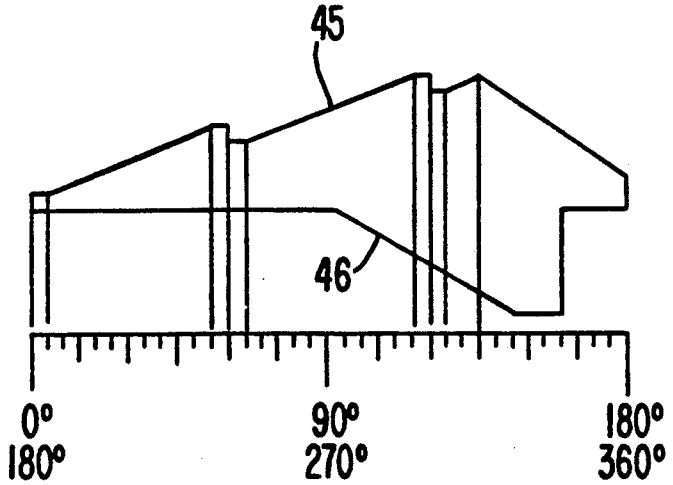
FIG. 13 is a layout of the cam surface for effecting changes in impact setting.

The cam 40 has two camming surfaces 45, 46 whose layout is shown on FIG. 13. It is to be understood that the configuration shown in FIG. 13 represents a rotation of the cam 40 between 0° to 180° and 180° to 360° so that, in effect, the actual cam 40 can be rotated from the "NO" setting through the "LO" setting to the "HI" setting in FIG. 1, or through the same settings on the other side of the tool handle shown in FIG. 2. The cam surface 45 cooperates with a cam surface 47 formed on the inside wall if the rear handle portion 12 as shown in FIG. 5.

The blade 90, as previously noted, has a cutter 91 freely pivotally mounted thereon with a pivot pin 92. The forward end of the blade 90 is notched at 93 to form a seating edge which receives a wire therein.

II. Operation of the Impact Tool

A. Low (LO) Impact and Cutting Function

FIGS. 3 and 4 show the relationship of the above described parts when an arrow "V" on the outside of pouch 30 of the tool 10 is set to the "LO" or low impact position calibration. The tool 10 is at rest as illustrated in FIG. 3 and has a scissor-type blade 90 with a cutter 91 inserted into bore 22 of the slide 20 in the tool. The switch 13 has been moved into the "CUT" position so that the V-shaped legs of the notch 73 in the end of the actuator 70 surround an end of the cutter 91. The hammer 50 is shown canted under the bias power spring 39 with the projection 52 at the forward lower right-hand corner bearing against the flat surface 64 of the deactivator 60. The trigger cam surface 84 of the trigger 80 is in the slot 71 of the actuator 70, which slot is axially disposed at each end with a generally V-shaped portion formed by a tab 75 intermediate the ends to effect the cutting operation in conjunction with the cam portion 84 hereinbelow described. The cam surface 61 of the deactivator 60 is axially separate from the cam surface 46 on the cam 40 on both the low (LO) and high (HI) impact setting positions.

Figure 17:
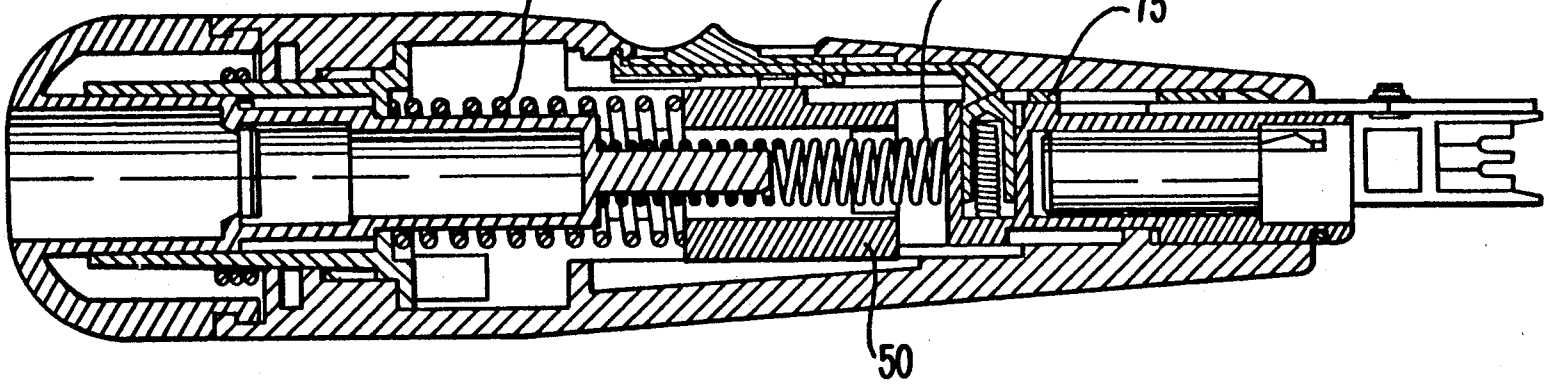
FIG. 17 is a view similar to FIG. 4 but showing the tool in the low-impact setting, cutting mode at the impact triggering position.

The operator then pushes the tool 10 against the connection in a known manner to the impact triggering position shown in FIG. 17. The power spring 39 and the return spring 37 have now been compressed, and the projecting portion 84 of the trigger cam surface 83 has moved along the slot 71, is pushed under the V-shaped tab portion 75 by the sloped camming surface into the most rearward, axially disposed end of the slot 71. The hammer 50 has now been moved axially rearward toward the rear handle portion 12 and now aligns with the axis of the tool 10 rather than being twisted or canted as shown in FIG. 3. Upon alignment of the projecting end 54 of the hammer 50 with the U shaped recess 53 in the slide 20, the power spring 39 can now push the hammer 50 with a force of predetermined magnitude and impact against the slide 20 to cause the impact operation in the position shown in FIG. 18 while the tool 10 is still compressed.

Figure 20:
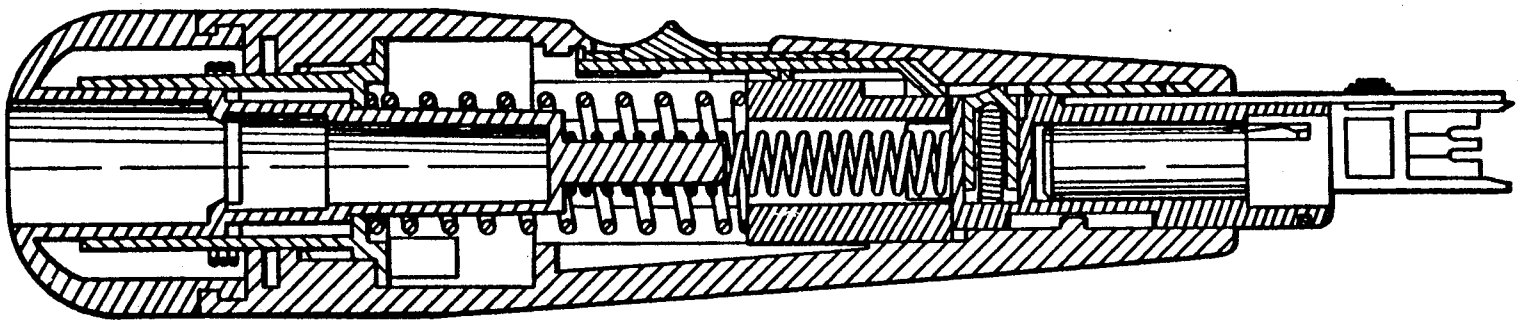
FIG. 20 is a view corresponding to FIG. 18 and is a partial sectional view of FIG. 19.

Now as the operator releases pressure on the tool 10 and the blade-end of the slide 20 moves back toward the right relative to the front handle portion 11 as shown in FIGS. 19 and 20 under the bias of return spring 37, the back side of the cam 83 of the trigger 80 engages in one oblique portion of the V-shaped section of slot 71 and causes the actuator 70 to move clockwise, as viewed in FIG. 19, causing the seating edge notch 73 of the actuator 70 to move the blade cutter 91 counterclockwise through a shearing motion to cut a wire (not shown).

B. Non-Cutting Function

Figure 21:
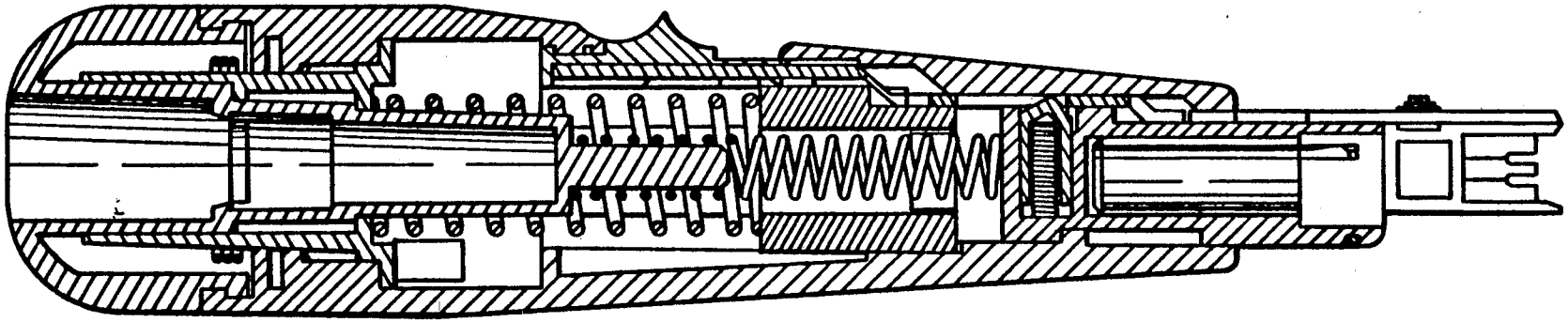
FIG. 21 is a view similar to FIG. 4 but with the switch in the "NO CUT" position showing the tool at rest.
Figure 22:
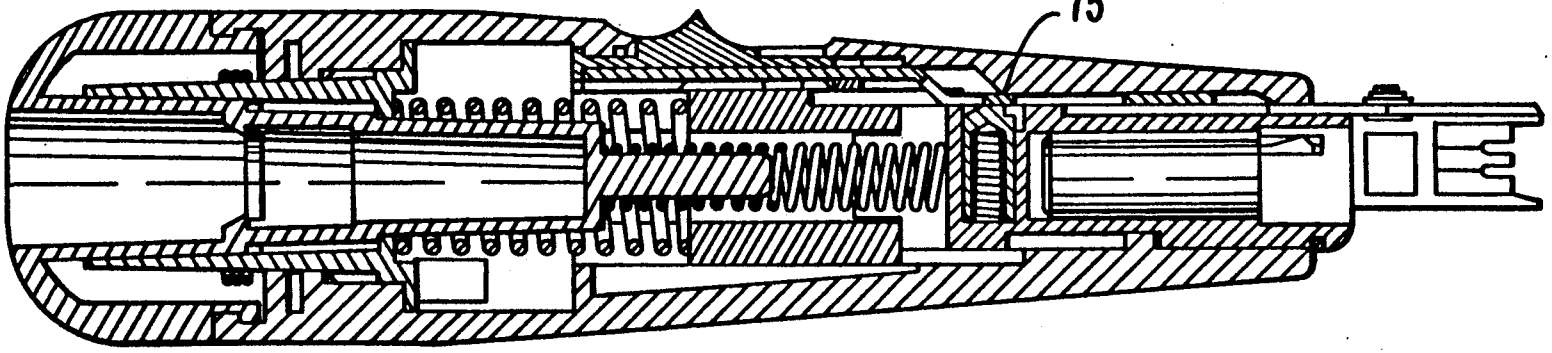
FIG. 22 is a view corresponding to FIG. 21 but showing the tool at the impact triggering position.

FIGS. 21 and 22 show the tool 10 again in a "LO" (low) impact position but with the switch 13 moved to the "NO CUT" position so that the actuator 70 is moved rearwardly in the rest position shown in FIG. 21. The operation of the tool 10 through impact is identical to that described above, except that after the impact triggering position is reached when the slide 20 begins to move rightwardly relative to the top handle 11, the cam 83 does not travel any further and remains underneath the actuator tab 75 as seen in FIG. 22. Upon further movement of the slide 20 to the right when the pressure on tool 10 is released after impact, the cam 83 will not ride in the oblique portion of the V-shaped section of slot 71 and cause pivoting of the cutter 91. Instead, it merely springs upwardly into the axially disposed forward portion of the slot 71. As a result, the tool 10 performs a seating function only.

C. NO IMPACT FUNCTION

Figure 23:
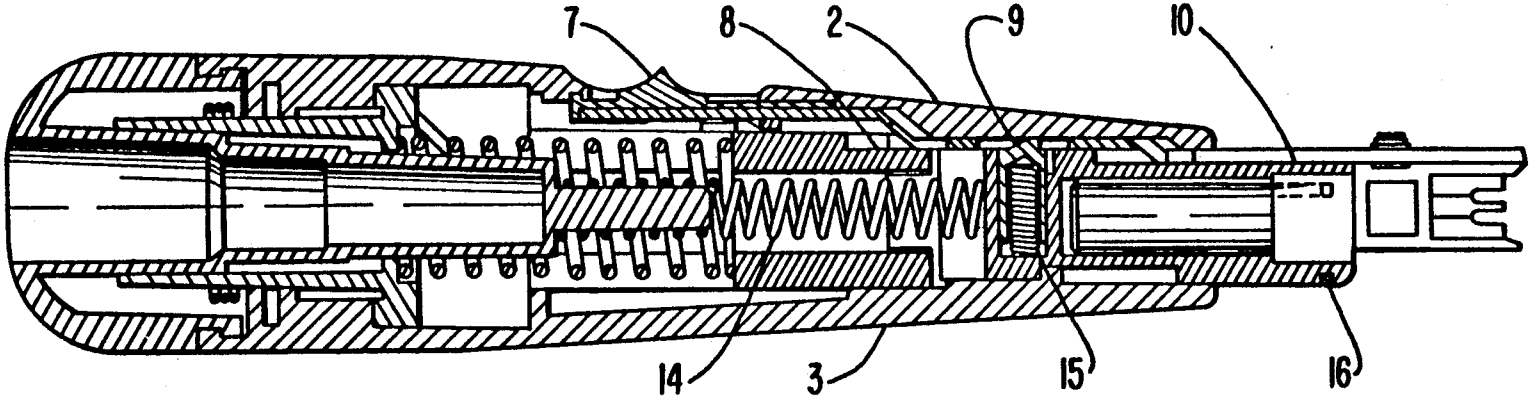
FIG. 23 is a view similar to FIG. 4 but with the tool at the no impact setting and in the cutting mode.
Figure 24:
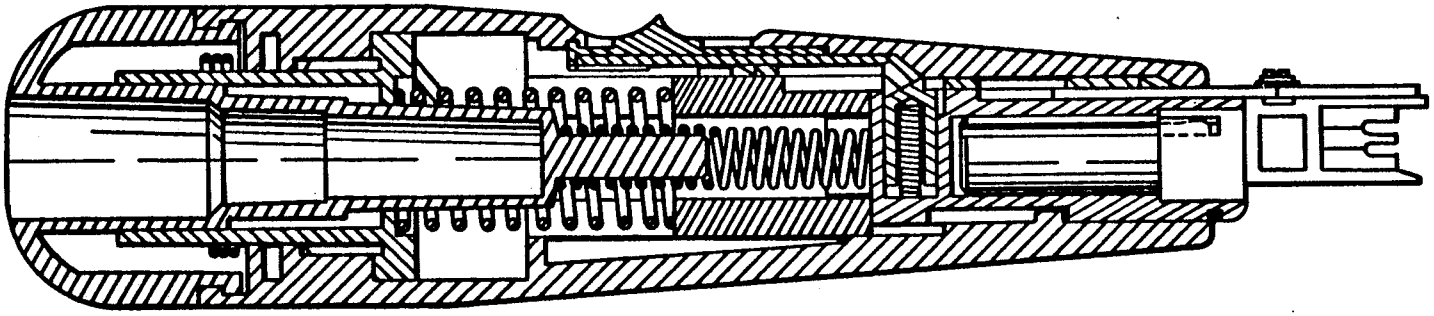
FIG. 24 is a view corresponding to FIG. 23 but with the tool in the fully compressed position.

If cutting is desired but not impact seating, the pouch 30 is rotated so that the "V" arrow aligns with the "NO" impact position on the rear handle portion 12 to rotate the cam 40 so that the cam surface 46 pushes surface 62 of the deactivator 60 forward in the blade direction, and the deactivator 60 moves axially as well, so that, in the rest position of FIG. 23, the projection 54 of hammer 50 is aligned with the U shaped recess 53 in the slide 20 so that the hammer 50 and slide 20 travel together as the tool 10 is compressed into the position shown in FIG. 24. The switch 13 is already in the "CUT" position shown in FIG. 4. Now, as the slide 20 is permitted to return to its home position, the cam portion 84 will travel in the oblique portions of the slot 71 so that first the cutter 91 will be rotated counterclockwise and then clockwise after the cutting operation takes place as previously described.

The cutting operation is essentially the same as described above with regard to FIGS. 19 and 20 once the tool 10 has reached the fully compressed position shown in FIG. 24. The trigger 80 is now fully extended through the aperture slot 71, and as the slide 20 moves forwardly, the trigger cam surface 83 moves the blade 91 counter clockwise through the cutting operation to the position of the blade shown in FIG. 19 and then clockwise to the starting position.

D. High (HI) Impact

Figure 18:
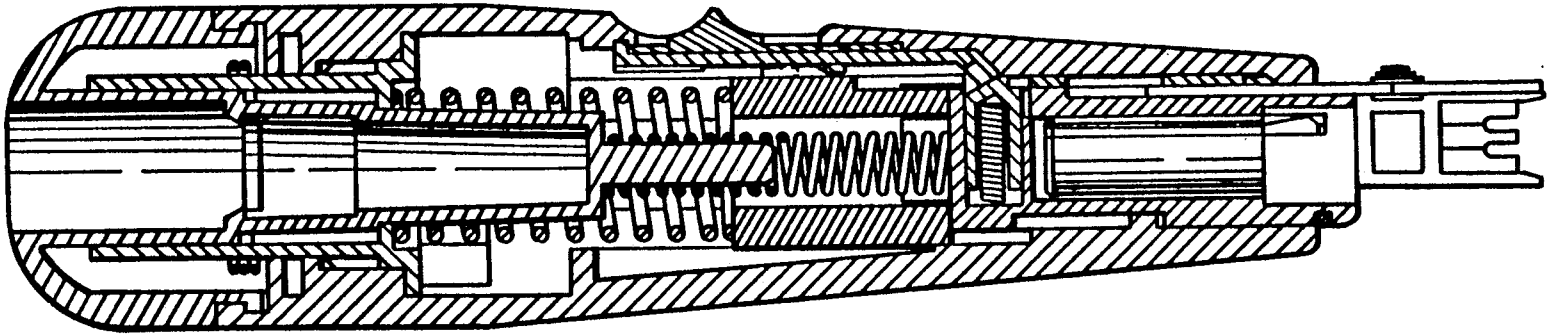
FIG. 18 is a view corresponding to FIG. 17 but with the tool now having effected impact at the connection.

The operation of the tool 10 with regard to the impact cutting functions described above for low impact and of the non-cutting function can be carried out by moving the pouch 30 so that the arrow "V" aligns with the HI (high) impact setting on the rear handle portion 12. This action turns the cam 40 so that the camming surface 45 causes the power spring 39 to compress to the maximum extent so that a greater spring force will be applied as the hammer 50 is triggered from its triggering position (FIG. 17) toward its impact position (FIG. 18). The cam 40 is provided with ratcheting recesses 48 at the setting transitions on cam surfaces 45 so that rotation of the pouch 30 to different settings can only take place in one direction.

E. Blace Release

The length of the central bore 31 in pouch 30 is sized such that a standard termination blade can be held therein by one leg 17" of the coil spring 17 which presses in a radial direction toward the center of the hollow section. When the pouch 30 is rotated slightly in the direction of the arrows indicated by "BLADE RELEASE" on the rear handle portion 12, then the tool 10 can be turned towards the vertical position with the pouch 30 pointing downwardly so that the blade can be removed by gravity. The spring leg is received within a circumferential groove in the tool securely to maintain the blade in the pouch when the blade is not in use.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A hand-held impact tool, comprising:

a handle;

a pouch assembly rotatable relative to the handle;

a hammer operatively arranged within the handle for causing an impact force;

a slide adapted to hold a blade with a pivotable cutter, the slide being axially movable within the handle and operatively associated with respect to the hammer to receive and transmit the impact force to the blade;

an actuator arranged within the handle and adapted selectively to engage the pivotable cutter when a cutting operation is desired;

a trigger operatively mounted on the slide and configured so as to operatively cooperate with the actuator for causing cutting movement and a return movement and a return movement of the cutter; and a cam assembly operatively mounted in the handle for movement by the pouch assembly in one direction to allow selection of a no-impact force setting and at least one other impact force setting.

2. The hand-held impact tool according to claim 1, wherein the pouch assembly includes a bore for storing a blade, and a coil spring operatively arranged with respect thereto such that movement of the pouch assembly in another direction will cause enlargement of a portion of the coil spring and allow insertion of the blade into or removal of the blade from the bore with the coil spring in a biased state, and release of the spring bias will retain the blade inserted in the bore.

3. The hand-held impact tool according to claim 1, wherein a switch is provided at the handle and is operatively associated with the actuator to set a cutting position where movement of the cutter occurs after impact of the hammer upon the slide and a no-cutting position where movement of the cutter does not occur after impact of the hammer upon the slide.

4. The hand-held impact tool according to claim 1, wherein the cam assembly includes a deactivator moveable within the handle in relation to the hammer, the deactivator being sized and configured such that upon movement of the pouch assembly in the one direction to the no-impact force setting the hammer is caused to move in unison with the slide without impact therebetween.

5. The hand-held tool according to claim 3, wherein the pouch assembly includes a bore for storing a blade, and a coil spring operatively arranged with respect thereto such that movement of the pouch assembly in another direction will cause enlargement of a portion of the coil spring and allow insertion of the blade into or removal of the blade from the bore with the spring in a biased state, and release of the coil spring bias will retain the blade inserted in the bore.

6. The hand-held impact tool according to claim 5, wherein the cam assembly includes a deactivator moveable within the handle in relation to the hammer, the deactivator being sized and configured such that upon movement of the pouch assembly in the one direction to the no-impact force setting the hammer is caused to move in unison with the slide without impact therebetween.

7. The hand-held impact tool according to claim 1, wherein a power spring sized to effect a sufficient impact force is arranged between the cam assembly and the hammer so that movement of the pouch assembly in the one direction will selectively lengthen and shorten the power spring.

8. The hand-held impact tool according to claim 7, wherein a return spring weaker than the power spring is operatively arranged between the pouch assembly and the slide for normally biasing the slide outwardly of the handle.

9. The hand-held impact tool according to claim 8, wherein the pouch assembly includes a bore for storing a blade, and a coil spring operatively arranged with respect thereto such that movement of the pouch assembly in another direction will cause enlargement of a portion of the coil spring and allow insertion of the blade into or removal of the blade from the bore with the spring in a biased state, and release of the coil spring bias will retain the blade inserted in the bore.

10. The hand-held impact tool according to claim 9, wherein a switch is provided at the handle and is operatively associated with the actuator to set a cutting position where movement of the cutter occurs after impact of the hammer upon the slide and a no-cutting position where movement of the cutter does not occur after impact of the hammer upon the slide.

11. The hand-held impact tool according to claim 10, wherein the cam assembly includes a deactivator moveable within the handle in relation to the hammer, the deactivator being sized and configured such that upon movement of the pouch assembly in the one direction to the no-impact force setting the hammer is caused to move in unison with the slide without impact therebetween.

12. The hand-held impact tool according to claim 1, wherein the slide has a bore for receiving the blade, and a retaining spring is operatively arranged on the slide to retain the blade in the tool in a selectively releasable manner.

13. The hand-held impact tool according to claim 1, wherein the blade is a scissor-type blade and includes a shank portion at one end thereof with a configuration for being releasably held in the tool for easy interchangeability, and the pivotable cutter comprising the scissor-type blade is operatively mounted for the selective actuation.

14. A method for effecting conductor terminations in a terminal block, comprising the steps of:

mounting a blade with a seating edge and a pivotable cutter thereon in a handle of a hand-held impact tool;

turning a pouch assembly relative to the handle to obtain no impact force or at least one level of impact force;

selecting whether the pivotable cutter will be actuated or non-actuated;

placing the seating edge of the blade over a conductor in the terminal block; and pushing the handle toward the conductor to effect at least one of a cutting operation in which the cutter is pivoted in relation to the seating edge and a seating operation.

15. A hand-held impact tool, comprising:

a handle having two ends;

means for releasably holding a blade at one end of the handle to effect at least one of an impact seating operation and a cutting operation;

means rotatably mounted at the other end of the handle for effecting changes in tool impact force setting in one direction of rotation of the second-mentioned means relative to the handle and for selectively storing a blade in or removing the blade from a storage area in the second-mentioned means in another direction of rotation; and means associated with the handle for switching between a cutting position and non-cutting position of the blade.

16. The hand-held impact tool according to claim 15, wherein the blade is a scissor-type blade, which constitutes an easily replaceable element of the tool retained therein by the releasable holding means, comprising a pivotable cutter operatively mounted for selective operation and actuated by a mechanism within the tool.

17. The hand-held impact tool according to claim 15, wherein the blade comprises a seating edge and a pivotable cutter selectively engageable by the switching means for effecting a scissor-like cutting of a conductor at the seating edge.

18. The hand-held impact tool according to claim 17, wherein the switching means comprises an actuator operatively connected with the blade holding means.

* * * * *